United States Patent [19]

Lowe

[11] 4,187,585

[45] Feb. 12, 1980

[54] CARDING MACHINE DRIVING APPARATUS

[75] Inventor: Jerry B. Lowe, Simpsonville, S.C.

[73] Assignee: John D. Hollingsworth on Wheels, Inc., Greenville, S.C.

[21] Appl. No.: 890,253

[22] Filed: Mar. 27, 1978

[51] Int. Cl.[2] ..... D01G 15/36

[52] U.S. Cl. ..... 19/98; 188/18 A

[58] Field of Search ..... 19/98, 99; 188/17, 18 A, 188/58, 76

[56] References Cited

U.S. PATENT DOCUMENTS

| | | | |
|---|---|---|---|
| 3,530,542 | 9/1970 | Burnham | 19/98 X |
| 3,780,834 | 12/1973 | Lottridge et al. | 188/18 A |
| 4,075,142 | 2/1978 | Morse et al. | 188/18 A X |

*Primary Examiner*—Louis Rimrodt

*Attorney, Agent, or Firm*—Bailey, Dority & Flint

[57] ABSTRACT

A carding machine drive having an instantaneous braking system is illustrated wherein the driven main cylinder and carding components driven therefrom may be stopped instantaneously in about three seconds or less avoiding breakage of the web. A disk element is employed having opposed braking surfaces which are clampingly engaged by caliper means which are fixed to the card frame. The disk element has fixed connection and transverse alignment concentrically with the main cylinder.

5 Claims, 4 Drawing Figures

CARDING MACHINE DRIVING APPARATUS

BACKGROUND OF THE INVENTION

A means for instantaneously stopping the main cylinder of a card has long been sought for safety reasons. The great danger to operating personnel engendered by the rotation of the massive main cylinder clothed with wire teeth is well known to those skilled in the trade and it has heretofore been thought impossible to effect a relatively rapid or instantaneous stop. By instantaneous stop it is meant that the main cylinder may be stopped within about three seconds or in less time than it usually takes to create damage. By use of the apparatus of the present invention it is possible to stop the main cylinder before the hand or arm of the operator may become engaged in its teeth. To this end it is desirable that safety switches be provided operable by movement of a safety trip bar or lever, or by removal of covers, cover plates or doors and the like so that the main cylinder will be stopped before it becomes accessible to operational personnel.

While electric brakes and the like have been utilized in connection with certain textile carding and drafting aparatus such as illustrated in U.S. Pat. No. 3,530,542 such have proved to be impractical insofar as providing an instantaneous stop. Efforts to utilize electric brakes such as illustrated in the patent have proved to be impractical to create an instantaneous stop and are not serviceable over a long period of time. This is because by their nature they are concentrically mounted and a minimum of lever arm is afforded in order to create stopping torque.

Another advantage of an instantaneous stop is to make it possible to stop the various carding elements associated with or driven by the main cylinder quickly and in proportion so as not to cause the web to come down but rather to remain up so that carding may be resumed quickly. It would thus be possible to stop the card without having to put up the web each time when starting again. This would be of special advantage in stops over the weekend where the card may simply be restarted without having to put the ends up at the beginning of the week.

The instantaneous stopping apparatus is especially desirable for the use when conducting maintenance operations. During maintenance operations the card is blown down or cleaned by blasts of air in which case it is necessary to move the covers and perhaps the clean-out doors at the bottom of the frame. For safety reasons when clearing chokes, it is important that the main cylinder be stopped. This normally takes about ten minutes and operators have the tendency to become impatient and may not realize that the main cylinder is still rotating. Safety switches for actuating the braking mechanism of the invention may be placed in a number of locations such as on the doors and covers, as well as on the regular panel for the electrical circuitry. It is important that the braking mechanism be carried adjacent the main cylinder shaft on the side of the card.

BRIEF DESCRIPTION OF THE INVENTION

It has been found that instantaneous stopping of the main cylinder of a carding machine and associated carding elements may be effected through the use of a disk brake system wherein a disk having opposed braking surfaces concentrically carried in relation to the main cylinder may be secured in fixed relation to the main cylinder and calipers provided for effecting stopping action through suitable circuitry by safety switches such as actuated by removal of a carding element such as a door or cover or any other suitable device.

Thus, the apparatus of the invention contemplates providing a synchronous stop which is especially desirable for safety purposes, but it is also important in that the web is not lost during a cleaning operation and the like avoiding the necessity for putting the end up on each stoppage of the card.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a carding machine having a frame carrying a driven man cylinder and drive means connected thereto for driving other carding components therefrom. An instantaneous braking system includes a disk element having opposed braking surfaces A and means B fixing the disk element to the main cylinder in transverse outwardly spaced alignment therewith with the opposed braking surfaces extending outwardly, concentrically of the main cylinder. Caliper means C have spaced opposed brake pads engaging the opposed braking surfaces. Means D are provided for fixing the caliper means in respect of the frame. Guard switch means E are provided on the carding machine actuating the caliper means for effecting clamping engagement.

Figure 1:
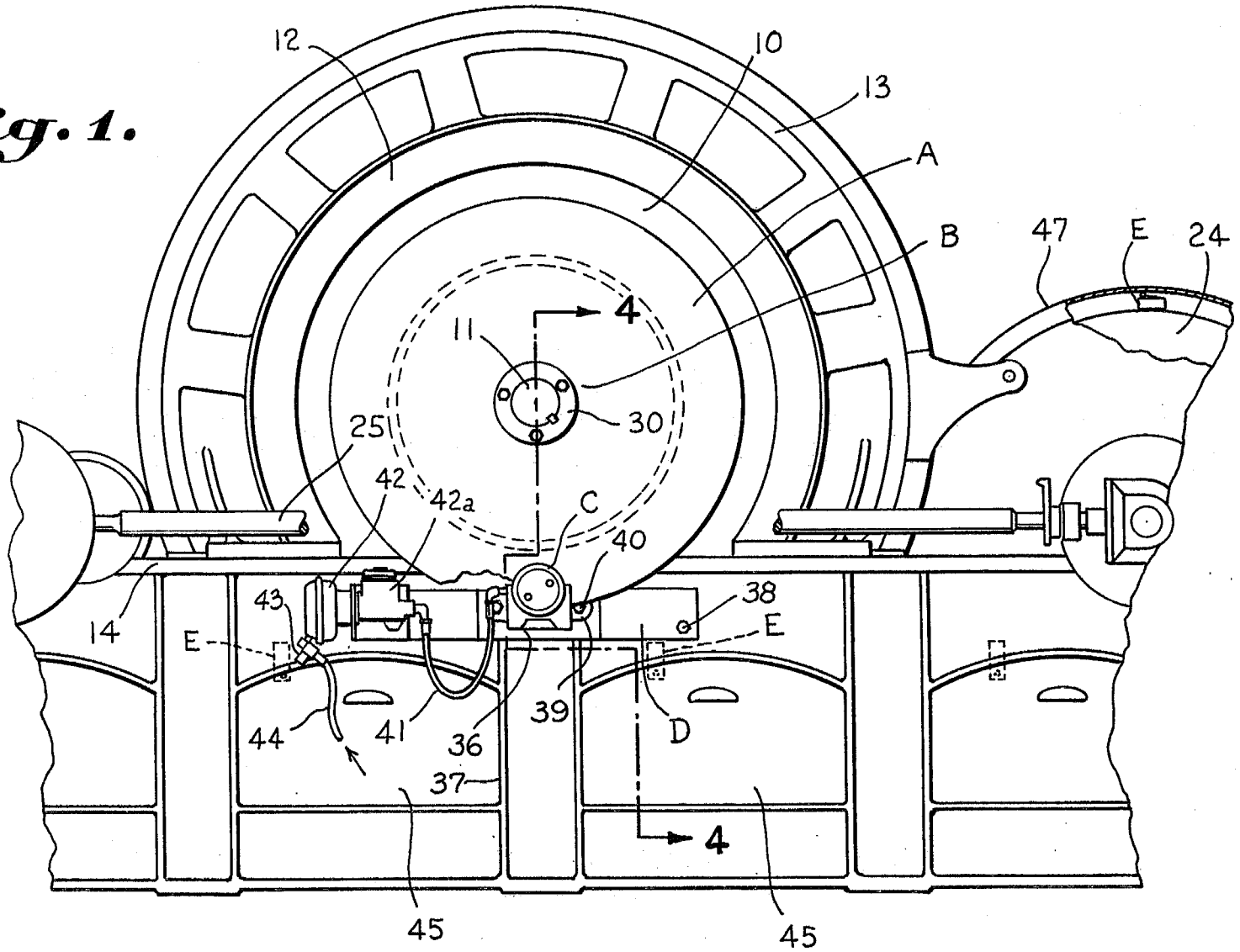
FIG. 1 is a side elevation illustrating a carding machine equipped with the braking mechanism constructed in accordance with the present invention.

The carding machine illustrated in FIG. 1 shows a main cylinder 10 which is carried by a shaft 11 within the arch 12. The arch may be provided with stationary flats as illustrated at 13 or movable flats (not shown) may be employed. The arches 12 are mounted on opposed card frame members 14.

Figure 2:
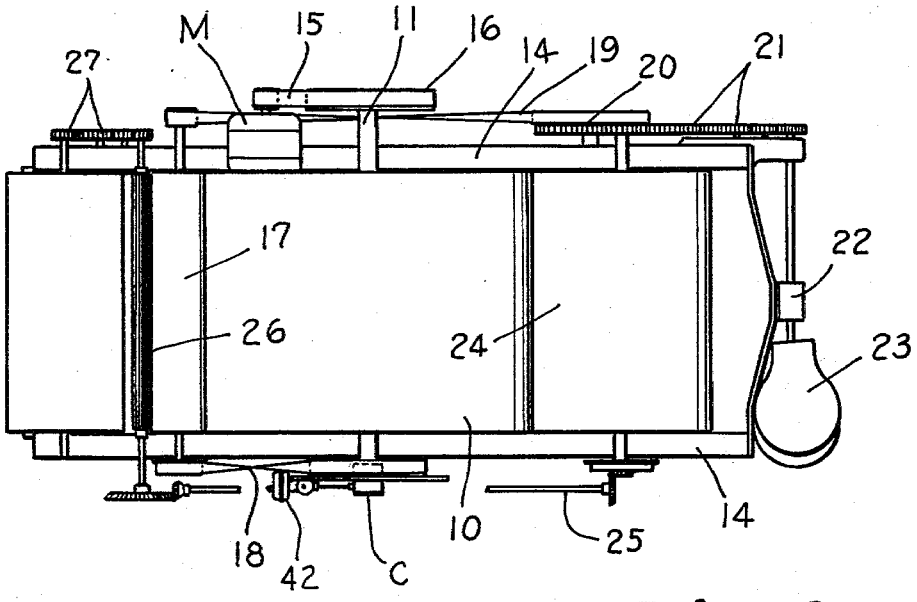
FIG. 2 is a plan view illustrating the positioning of the braking mechanism in relation to the other drive elements of a card.

Referring more particularly to FIG. 2, it will be noted that the main cylinder 10 is driven by a motor M through a power takeoff mechanism which includes a belt 15 which drives the pulley 16 which has fixed connection to a cylinder shaft 11.

The lickerin roll 17 is driven from the main cylinder through a belt 18 and the lickerin, in turn, through a belt drive 19, drives the barrow pulley 20. The barrow pulley 20 through a suitable gear train 21, drives the calendar rolls 22 and certain parts of the coiler 23. The doffer 24 drives through a shaft 25, the feed roll 26 which, in turn, drives suitable feed mechanism through the gear train 27.

Figure 4:
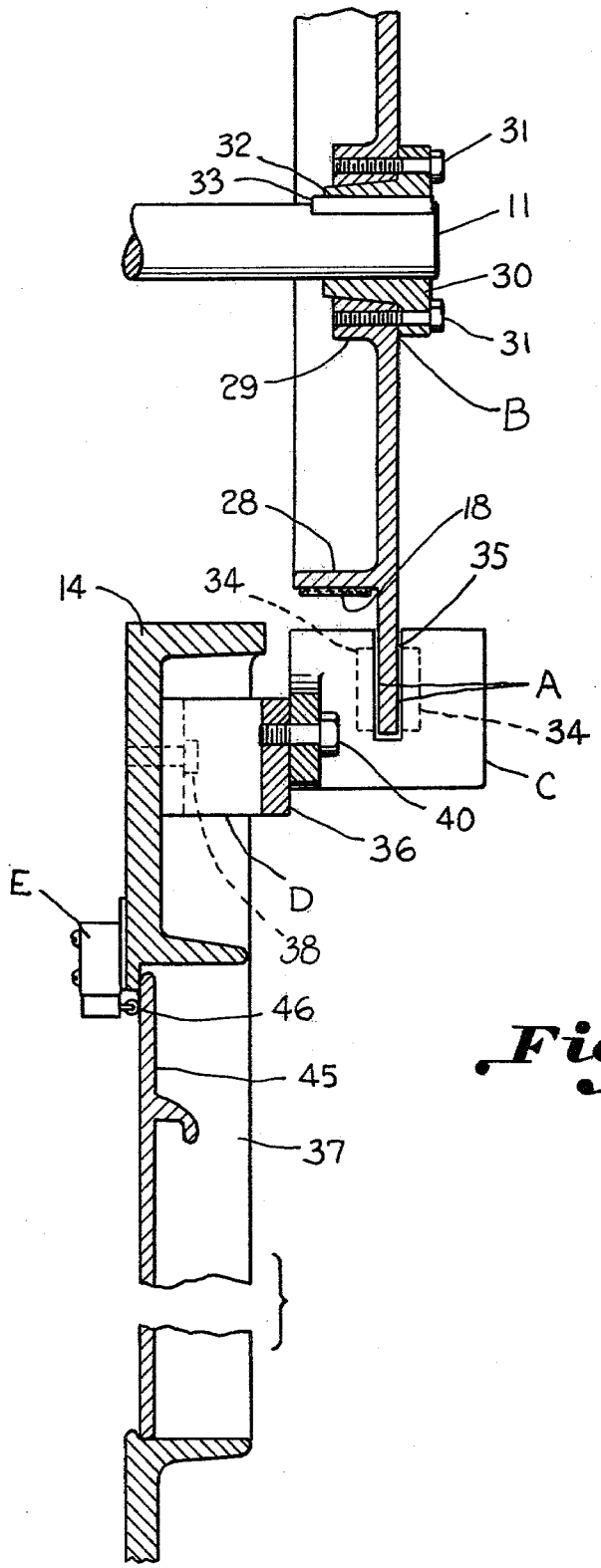
FIG. 4 is transverse sectional elevation taken on the line 4—4 in FIG. 1.

The braking surfaces A of the disk element are machined so as to be in true transverse relationship with the main cylinder and are smooth. The means B includes the bracket which carries the braking surfaces A and as is best seen in FIG. 4, includes a drive pulley 28 for driving belt 18 which in addition, acts as an arcuate reinforcing means. The bracket has a hub member 29 which is secured as by a bushing 30 to the cylinder shaft 11. The bolt 31 threadably tightens the bracket hub 29 upon a tapered portion 32 of the bushing 30. A suitable key 33 secures the tapered member 32 upon the shaft 11. It can be seen that the brake disk element is an extension of the drive pulley surface and the two may be cast as one piece. Separate brake disk and pulley elements, integrally attached are also contemplated.

The caliper means C includes a pair of opposed braking pads 34 which define a space 35 therebetween for accommodating the braking surfaces A. Through suitable fluid operated cylinders, (not shown) the pads 34 are caused to grippingly engage the braking surfaces A. Means D for fixing the caliper in respect to the frame includes a substantially rectangular elongated bracket which has an outwardly projecting central portion 36 for accommodating the vertical braces 37 of the frame members 14. The bracket D is bolted as by bolts 38 to an upper portion of the frame in vertical alignment with the shaft 11 of the main cylinder. A plate 39 is provided for removably securing as by bolts 40, the caliper C to the frame member. Pressurized fluid is provided to the caliper through the line 41 from an air operated hydraulic actuator 42 which pressurizes hydraulic fluid in master cylinder 42*a*. The actuator 42 is afforded with air from a solenoid valve 43 through the line 44 from a suitable source as may be normally associated with the card.

It will be noted that suitable guard switch means E are associated with each of the cleanout doors 45 carried adjacent a lower portion of the frame. As will be noted from FIG. 4, the cleanout doors 45 maintain the switch means E in open position by depressing the switch lever 46. Similar switches E are associated with a cover member shown schematically and broken away at 47 in FIG. 1 just above the doffer 24. Similar switches may be associated with guards (not illustrated) mounted at any point on the card which will, when actuated, initiate the operation of the brake mechanism.

OPERATION

Figure 3:
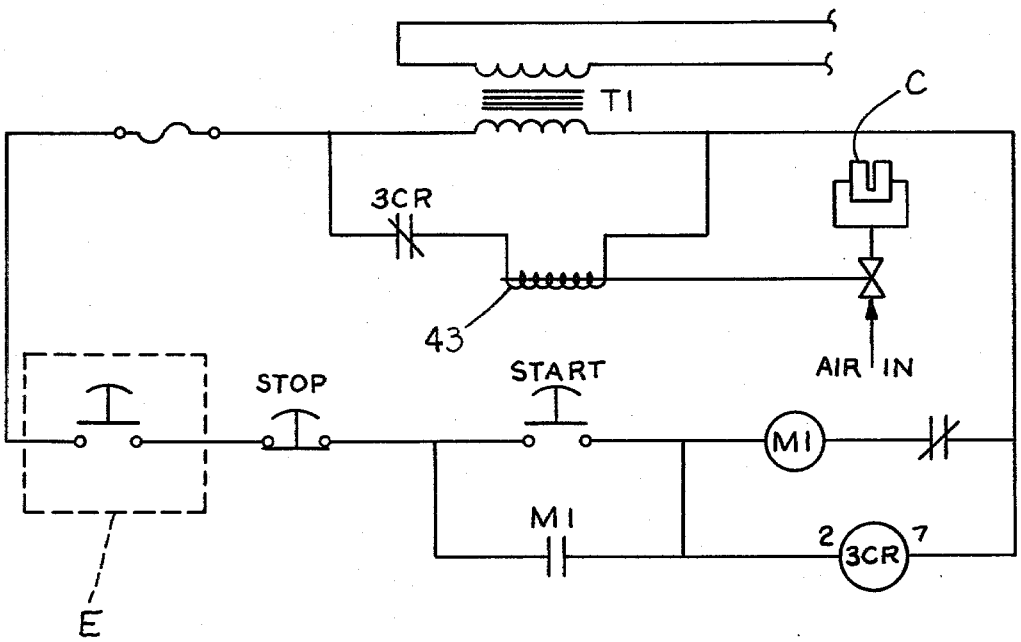
FIG. 3 is a schematic diagram illustrating the various electrical components utilized in operating the braking mechanism in accordance with the invention.

The safety or guard switches, one of which is illustrated at E in FIG. 3, are connected in series with the main card control stop switch. The safety switches may be normally open as illustrated, and are closed by the physical presence of the cover, the door or other part of the card which it is intended to guard. For example, the weight of a cover mounted on the side of the card may be used to hold the switch closed. A guard switch E is also illustrated in connection with the doors through the flanges. All the series wired safety switches must be closed, therefore, all covers or doors must be safe before the supply transformer T can energize the circuit. Assuming all safety switches to be closed, motor contacts M1 are closed by pushing the start switch. At the same time control relay 3CR is energized and remains energized as long as contacts M1 are closed.

The energized control relay 3CR opens the normally closed contacts which are in series with the three-way solenoid valve 43. De-energizing of the solenoid valve cuts off air line pressure to the brake actuator and allows the brake actuator to bleed to atmospheric pressure. When the actuator pressure is released, the calipers release the brake disk. The cylinder motor starts the cylinder and runs the card.

Disturbing the electrical condition of any of the safety switches or the stop switch removes power from relay M1 resulting in opening normally open contacts M1. At the same time power is removed from contacts of relay 3CR. This allows closing of the normally closed contacts of 3CR energizing the solenoid valve coil. This allows air to pass to the brake actuator 42 and the caliper to clasp the brake disk. This stops the cylinder in a short time interval, also stopping the lickerin.

As may be seen from FIG. 3, removing power by releasing the M1 contacts also removes control power from all motor relays resulting in power loss to the motors or motor which drive the card. The cylinder and lickerin are stopped by the disk brake. Any other components mechanically coupled to the cylinder are stopped by the brake. Other moving machine elements including the doffer, if disengaged as through a conventional clutch arrangement or other means which permit coasting may coast to a stop. In general, such coasting elements stop in less than two seconds. The stopping rate of the cylinder depends on caliper pressure, but three seconds total stopping time is attainable.

While a preferred embodiment of the invention has been described using specific terms, such description is for illustrative purposes only, and it is to be understood that changes and variations may be made without departing from the spirit or scope of the following claims.

What is claimed is:

1. A drive for a carding machine having a frame carrying a driven main cylinder and other carding components including a doffer comprising:

opposed braking surfaces carried by disk means;

mounting means fixing said disk means to said main cylinder in transverse aligment therewith;

said opposed braking surfaces extending radially outwardly, concentrically of said main cylinder;

caliper means having spaced opposed brake pads clampingly engaging said opposed braking surfaces;

means fixing said caliper means in respect of said frame;

means driving said other carding components from said main cylinder; and switch means on said carding machine actuating said caliper means for effecting clamping engagement between said pads and respective opposed braking surfaces instantaneously stopping said main cylinder and other carding components;

whereby the coming down of the web produced by the carding machine is avoided.

2. The structure set forth in claim 1 including a lickerin driven from the main cylinder, said doffer being connected to said lickerin.

3. The structure set forth in claim 1 wherein said mounting means fixing said disk means are fixedly carried on a main cylinder shaft.

4. The structure set forth in claim 1 wherein said mounting means fixing said disk means to said main cylinder includes an annular bracket having a central hub, means for fixing said hub to a cylinder shaft, annular reinforcing means carried by an intermediate portion of said bracket and braking surfaces carried adjacent the periphery of said bracket on opposed sides thereof exteriorily of said reinforcing means.

5. The structure set forth in claim 4 wherein said means fixing said caliper means in respect of said frame includes, an elongated bracket fixed to said frame adjacent an upper edge thereof, said bracket having an outwardly projecting intermediate portion supporting said caliper means in vertical alignment with said disk means between said pads.

* * * * *